US008152663B2

(12) United States Patent
Grundman

(10) Patent No.: US 8,152,663 B2
(45) Date of Patent: Apr. 10, 2012

(54) TRACKABLE ARROW

(76) Inventor: Vincent Grundman, Maplewood, MN (US)

( * ) Notice: Subject to any disclaimer, the term of this patent is extended or adjusted under 35 U.S.C. 154(b) by 190 days.

(21) Appl. No.: 12/657,517

(22) Filed: Jan. 22, 2010

(65) Prior Publication Data

US 2011/0183789 A1 Jul. 28, 2011

(51) Int. Cl.
*F42B 6/04* (2006.01)
*F42B 6/06* (2006.01)

(52) U.S. Cl. ..... 473/578

(58) Field of Classification Search ..... 473/570, 473/578, 585, 586
See application file for complete search history.

(56) References Cited

U.S. PATENT DOCUMENTS

| | | | | |
|---|---|---|---|---|
| 4,856,792 | A * | 8/1989 | Hardison | 473/570 |
| 5,018,450 | A * | 5/1991 | Smith | 102/513 |
| 6,220,978 | B1 * | 4/2001 | Schroeder | 473/586 |
| 6,364,499 | B1 * | 4/2002 | Jones | 362/109 |
| 6,641,493 | B1 * | 11/2003 | Shifflett | 473/578 |
| 7,211,011 | B1 * | 5/2007 | Sutherland | 473/578 |
| 7,485,057 | B2 * | 2/2009 | Afshari | 473/586 |
| 2005/0178375 | A1 | 8/2005 | Sutherland et al. | |
| 2006/0084534 | A1 | 4/2006 | Flowers et al. | |
| 2007/0082766 | A1 | 4/2007 | Smith et al. | |
| 2007/0173359 | A1 | 7/2007 | Mowery et al. | |
| 2008/0207362 | A1 | 8/2008 | Kuhn | |
| 2009/0247333 | A1 | 10/2009 | Bottelsen | |
| 2009/0270207 | A1 | 10/2009 | Lee | |

* cited by examiner

*Primary Examiner* — John Ricci
(74) *Attorney, Agent, or Firm* — Mark A. Litman and Associates, P.A.

(57) ABSTRACT

An arrow for use with a bow has a shaft, an arrowhead and vanes, wherein at least one of the vanes or the shaft contain substantive phosphorescent dye or substantive phosphorescent pigment in a transparent or translucent carrier.

12 Claims, 2 Drawing Sheets

TRACKABLE ARROW

BACKGROUND OF THE INVENTION

1. Field of the Invention

The present invention relates to the field of arrows, such as archery arrows and hunting arrows and more particularly to archery or hunting arrows that can be found more easily in the dark.

2. Background of the Related Art

Archery and hunting with bow and arrows is one of the longest-lived sports and has been a hunting method common to a wide range of cultures throughout the world.

The arrow for hunting has an arrowhead mounted on the front end thereof, the arrowhead being very pointed at the front end portion thereof. At the moment where the arrow for hunting is moved from a bowstring of a bow and hits the body of a hunting target, the pointed end of the arrowhead cuts into the body of the hunting target to cause the arrow for hunting to get stuck into the body of the hunting target or competitive target, such that the arrow remains fixed in the hit target.

The arrowhead is fixed to a shaft which is used to receive and transmit kinetic energy from a drawn bowstring and to carry the arrowhead to its target is a stable flight path. The shaft is designed to provide an important balance between rigidity and flexibility which is needed at the different stages of aim, launch and flight. Wood shafts, particularly of Yew wood have been preferred.

To further stabilize the flight of the arrow, vanes have been provided to keep the shaft and the arrow oriented during flight. This is often done not just by the vanes (originally provided on the rear of the shaft by split and shaped feathers) keeping the flight path straight, but also by rotating the shaft and the arrow. The rotation of the shaft and the arrow tends to overcome any deformities in the shape, curvature or improper weight distribution of the shaft, feathers and arrowhead. This is accomplished by moving the radial deformities about the axis of the shaft in flight by rotating the arrow.

Arrows of quality manufacture have become increasing expensive and efforts are made to preserve the life of the arrows against damage and loss. One typical way of losing arrows has been for them to become embedded in foliage, especially at night. As the arrows and the foliage are wood, and the vanes (whether plastic or feathers) have traditionally been dark-colored, arrows can be easily camouflaged and lost in a natural environment.

One recent effort to avoid the loss of arrows in the dark is to paint the vanes with a phosphorescent ink. This has a number of disadvantageous that were not foreseen in the original effort. The inks could often be applied differentially and unevenly, to an extent that could add to flight instability or unevenness. The inks also would have to be designed specifically for the unique composition and type of material used on the vanes or damage could actually be done to the vanes, such as by ink solvent activity on the vane composition. Additionally, the use of added ink composition to the vane structure tends to add weight to the rear of the arrow, offering a further basis for flight effects. If this were already not enough fault, the concentration of the phosphors in the inks tended to be low and the inks would be capable of readily wearing off the vanes by abrasion (e.g., against the bow shaft or by handling) and so the durability of the inks coating was minimal. These effects were first noted by Applicant. It has just recently been learned that the application of the inks to vanes has impacted the actual stability of the vanes and their ability to remain adhered to the shaft. It is surmised that the solvent from the ink attacked the adhesive used to adhere the vane to the shaft such that the adhesive is weakened and the vane is more easily removed from the shaft.

Arrows and shafts and vanes may be provided in numerous styles and structures, as represented by some of the following prior art. Structures are shown in Published U.S. Patent Document Nos. 20090270207; 20090247333; 20080207362; 20070173359; 20070082766; 20060084534; and 20050178375, which describe arrow structures and process of manufacturing that are compatible with the technology described herein. Particularly where surface coatings, plastic material or composites are used in the structure of the shaft or vanes, the use of phosphorescent pigment additives is useful in the practice of the technology described herein. Each of the references cited is incorporated by reference herein, in its entirety.

SUMMARY OF THE INVENTION

An arrow for use with a bow comprises a shaft, arrowhead and at least three vanes, wherein at least one of the vanes has a translucent or transparent portion substantive to the vane that contains phosphorescent dye or pigment sufficiently close to the surface of the translucent or transparent portion substantive to the vane so as to be visible by the naked eye when phosphorescing at its maximum intensity when in a dark environment of less than 1 lumen per 10 cubic meters. The phosphorescent material may alternatively be in the structural material of the shaft or in a substantive coating or otherwise fixed on the shaft.

DETAILED DESCRIPTION OF THE INVENTION

An arrow for use with a bow comprises a shaft, arrowhead and at least three vanes, wherein at least one of the vanes or a portion of the shaft has a translucent or transparent portion substantive to the vane or shaft that contains phosphorescent dye or pigment sufficiently close to the surface of the translucent or transparent portion substantive to the vane or shaft so as to be visible by the naked eye when phosphorescing within 20% of its maximum intensity when in a dark environment (e.g., completely void of visible ambient light). The phosphorescent material may alternatively be provided in or to the structural material of the shaft or in a substantive coating or otherwise fixed on the shaft.

The term "substantive" as in "substantive to the vane" has a meaning relevant to the practice of the invention. A pigment or dye is substantive to the medium carrying it if at least 80% of the pigment is distributed over 50% of the volume of the carrying material (such as transparent or translucent polymer or composite) so that as the carrying material is abraded away, significant amounts of dye or pigment remain.

The total amount of dye or pigment in the vane or shaft should be sufficient to be viewable under dark conditions from at least 5 meters, such as a concentration of at least 6% by volume and preferably at least 10% by volume of the carrying material, with 10-20% by weight and 12-18% by weight of the vane composition being desirable amounts of phosphorescent pigment. The concentration may vary with the strength of the phosphorescence of the dye or pigment. Phosphorescent dyes include, but are not limited to, the following classes: Xanthene, Naphtalimides, Coumarins, Quinazolinones, Oxazines, Thiazines, Thioxanathines, Naphtholactam, Azlactone, Methine, Perylenes, Benzoxinones, etc. Phosphorescent pigments are better known in the commercial arts. Additionally, up to 5% of the vane composition (in addition to or replacing phosphorescent material) may be fluorescing material, such as 1-5% by weight of fluorescent dye or pigment (e.g., Saturn Yellow, Day Glo fluorescent pigment) to enhance visibility in environments with slightly more light available.

Figure 1:
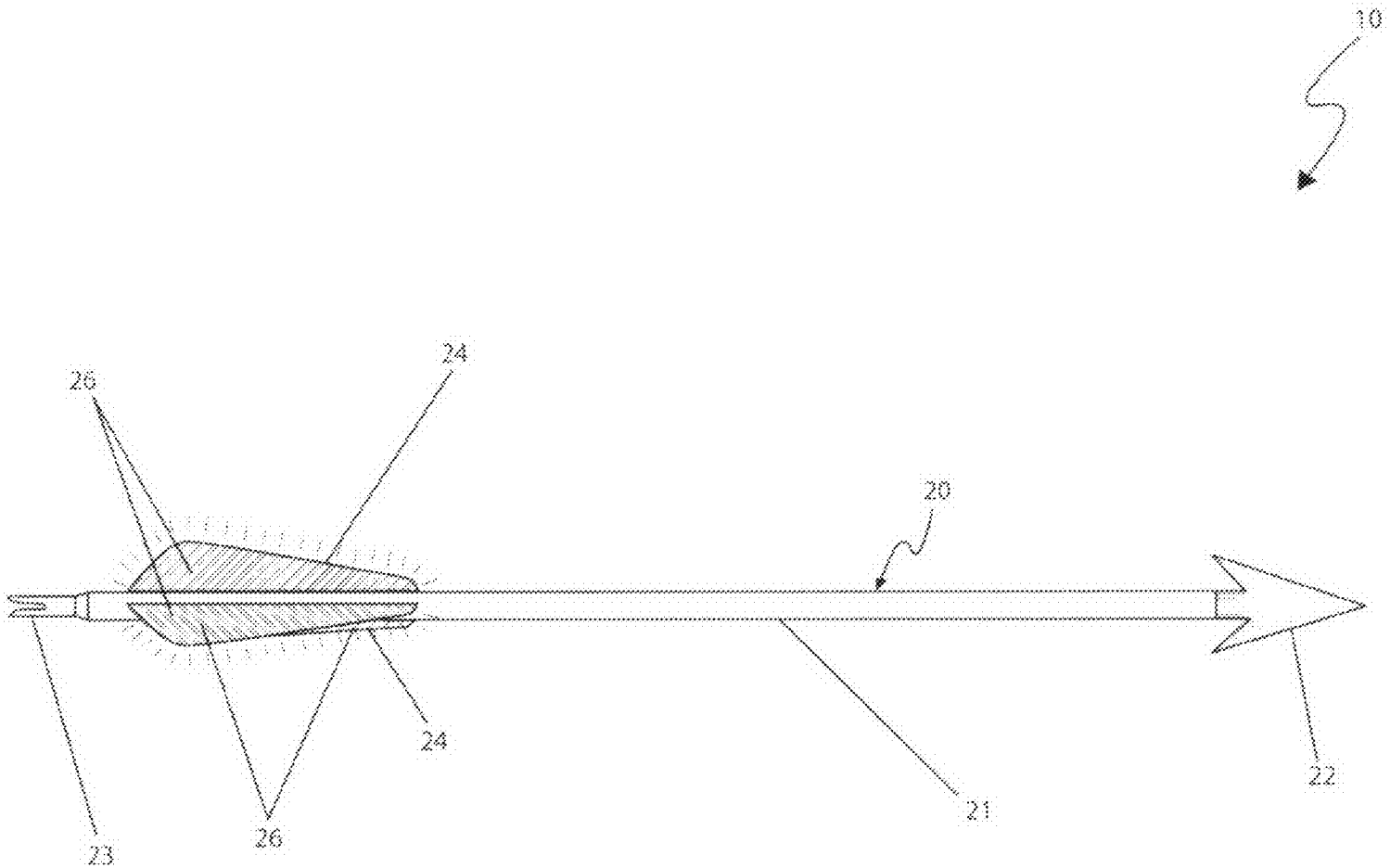
FIG. 1 shows a first arrow embodiment of the invention.
Figure 2:
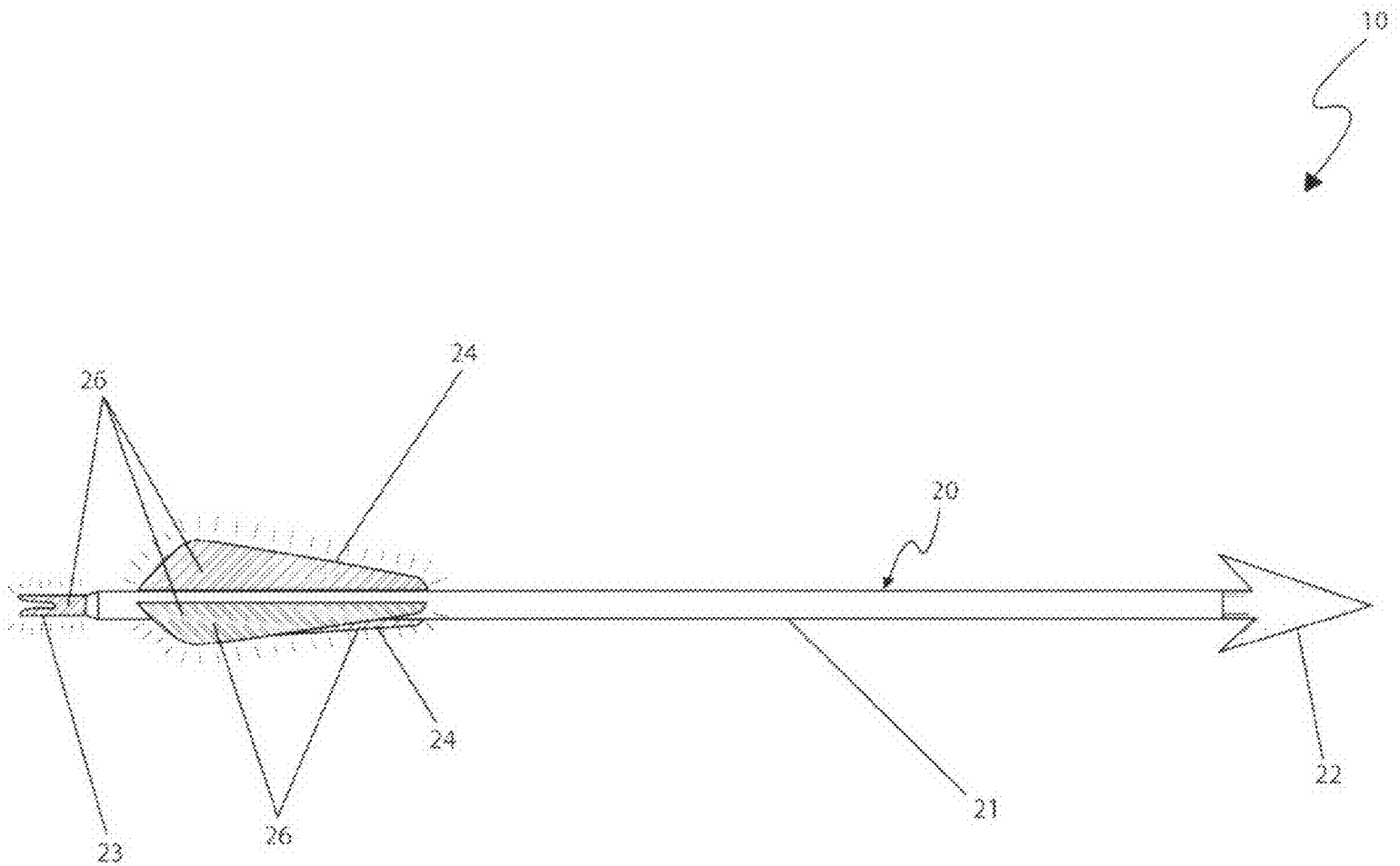
FIG. 2 shows a second arrow embodiment of the invention.

One best mode for carrying out the invention is presented in terms of its preferred embodiment, herein depicted within FIG. 1, and in terms of its alternate embodiment, herein depicted within FIG. 2. However, the invention is not limited to the described embodiment and a person skilled in the art will appreciate that many other embodiments of the invention are possible without deviating from the basic concept of the invention, and that any such work around will also fall under scope of the invention. It is envisioned that other styles and configurations of the present invention can be easily incorporated into the teachings of the present invention, and only one particular configuration shall be shown and described for purposes of clarity and disclosure and not by way of limitation of scope.

The present invention describes a device and method for an arrow with phosphorescent indicator (herein described as the "device") 10, which provides a means for locating and retrieving hunting arrows 20, particularly during times of limited visibility. The vanes 24 of the arrow 20 contain a substantive amount of phosphorescent dye or pigment in at least one and preferably all of the vane(s) 24, which will self-luminesce at night and give off radiation in the form of visible light. Additionally, the phosphorescent nature of the substantive composition can make finding the arrow 20 easier during the day.

The vanes 24 or shaft, by means of providing self-luminescence, will also make it easier for the hunter to track wounded game thereby preventing needless suffering and minimizing the possibility of another hunter claiming the game, or of an animal attacking the game and ruining the meat. The phosphorescent vanes 24 and/or phosphorescent shaft also provide a means of quickly locating lost arrows 20 that were shot at targets or game and might be stuck in trees, bushes or lying on the ground. As arrows 20 have become more expensive, this can represent a considerable cost savings. The phosphorescent paint 26 can also be applied if various colors that can be selected based on the environment that the device 10 will be used within.

The vanes, as indicated herein preferably may be a moldable or extrudable polymeric composition that is translucent or transparent (some color or opaque filler may be present) such as polyvinyl resins, acrylic resins, polyolefin resins, polyamide, polyesters, polyisocyanates, polysiloxane resins, other silicone resins, polyethers and the like. One preferred composition comprises a high molecular weight, reactive polyether polyol.

Referring now to FIG. 1, a side view of the device 10, according to the preferred embodiment of the present invention, is disclosed. The device 10 comprises an arrow 20, a shaft 21, an arrow head 22, a nock 23, and a plurality of vanes 24 with a substantive phosphorescent content.

The arrow 20 comprises a conventional arrow with all of the expected features such as a cylindrical shaft 21, an arrow head 22, a nock 23, and a plurality of vanes 24. The shaft 21 may be comprised of aluminum, carbon fiber reinforced plastic, wood, bamboo or the like. The arrow head 22 can be any of a variety of conventional types such as, but not limited to: bodkin points, blunts, judo points, broadheads, field tips, target points or the like, and are commonly made of metal or other hard material. The arrow head 22 is located on the front distal end of the shaft 21. The nock 23 is commonly fabricated from wood, plastic, or the like, and is located on the rear distal end of the shaft 21 opposite the arrow head 22. The plurality of vanes 24 are commonly fabricated from materials such as, but not limited to: feathers, plastic or the like. The vanes 24 are located around the circumference on the shaft 21 near the rear distal end just ahead of the nock 23. The substantive phosphorescent vane 24 gives a persistent emission of light following exposure to and removal of incident radiation thereby glowing in the dark. All of the components of the device 10 are readily available commercial items except for the vanes that may be molded with the appropriate composition as taught herein.

The substantive phosphorescent vanes 24 or substantive phosphorescent shaft 21 assists in making the device 10 unique.

Referring now to FIG. 2, a side view of the device 10, according to an alternate embodiment of the present invention, is disclosed. The alternate embodiment of the device 10 comprises an arrow 20 similar in nature to the preferred embodiment except that the substantive phosphorescent vanes 24 include a plurality of vanes 24 and to the nock 23.

It is envisioned that other styles and configurations of the present invention can be easily incorporated into the teachings of the present invention, and only one particular configuration shall be shown and described, for purposes of clarity and disclosure and not by way of limitation of scope.

What is claimed:

1. An arrow for use with a bow comprising a shaft, an arrowhead and vanes, wherein at least one of the vanes or the shaft contain substantive phosphorescent dye or phosphorescent pigment in a transparent or translucent carrier, wherein the vanes comprise three vanes on the shaft and at least one vane comprises at least 8% by total composition of the vane of phosphorescent dye or pigment.

2. The arrow of claim 1 wherein there are three vanes on the shaft and at least one vane comprises at least 8% by total composition of the vane of phosphorescent dye or pigment.

3. The arrow of claim 1 wherein there are three vanes on the shaft and at least one vane contains at least 10% by total weight of the at least one vane of phosphorescent pigment.

4. The arrow of claim 3 wherein all vanes are attached to the shaft by adhesive.

5. The arrow of claim 1 wherein there are three vanes on the shaft and at least one vane contains at least 10-20% by total weight of the at least one vane of phosphorescent dye.

6. The arrow of claim 1 wherein there are three vanes on the shaft and at least two vanes contain at least 12-18% by total weight of the at least one vane of phosphorescent pigment.

7. The arrow of claim 6 wherein all vanes are attached to the shaft by adhesive.

8. The arrow of claim 1 wherein the shaft has a portion of the shaft comprising substantive phosphorescent dye or phosphorescent pigment in a transparent or translucent carrier.

9. The arrow of claim 1 wherein the shaft has at least 25% of the length of the shaft comprising substantive phosphorescent dye or phosphorescent pigment in a transparent or translucent carrier.

10. The arrow of claim 9 wherein all vanes are attached to the shaft by adhesive.

11. The arrow of claim 9 wherein there are three vanes on the shaft and the carrier comprises at least 2% by total composition of the vane of phosphorescent dye or pigment.

12. The arrow of claim 1 wherein all vanes are attached to the shaft by adhesive.

* * * * *